US006244446B1

(12) United States Patent
Schmittel

(10) Patent No.: US 6,244,446 B1
(45) Date of Patent: Jun. 12, 2001

(54) METHOD AND APPARATUS FOR CONTINUOUSLY SEPARATING A MORE DENSE FRACTION FROM A LESS DENSE FRACTION OF A PULP MATERIAL

(76) Inventor: Richard L. Schmittel, 10175 Joerschke Dr. Suite 201, Grass Valley, CA (US) 95945

( * ) Notice: Subject to any disclaimer, the term of this patent is extended or adjusted under 35 U.S.C. 154(b) by 0 days.

(21) Appl. No.: 09/415,676

(22) Filed: Oct. 8, 1999

(51) Int. Cl.[7] ..... B03B 5/66

(52) U.S. Cl. ..... 209/157; 209/132; 209/155; 209/156; 209/158; 209/159; 209/233; 209/268; 209/270

(58) Field of Search ..... 209/270, 155, 209/157, 158, 159, 132, 156, 233, 268

(56) References Cited

U.S. PATENT DOCUMENTS

| | | |
|---|---|---|
| 4,056,464 | 11/1977 | Cross . |
| 4,279,741 | 7/1981 | Campbell . |
| 4,898,666 | 2/1990 | Kelsey . |
| 4,998,986 | 3/1991 | Campbell . |

*Primary Examiner*—Donald P. Walsh
*Assistant Examiner*—Mark J Beauchaine

(74) *Attorney, Agent, or Firm*—Flynn, Thiel, Boutell & Tanis, P.C.

(57) ABSTRACT

A method and centrifugal separator apparatus for separating more dense particles from less dense particles contained in a slurry. The separator apparatus receives slurry into a rotor assembly which includes a bowl open upwardly and a surrounding hutch chamber. The bowl has a lower impermeable portion coupled to a drive shaft for rotating the rotor assembly, an upper impermeable portion connected to the lower portion, and a frusto-conical screen. The frusto-conical screen forms the inner wall of the hutch chamber and discharge outlets are provided in the periphery of the hutch chamber. An annular fluid inlet connected to the hutch chamber supplies elutriation liquid continuously to the interior of the hutch chamber, and a plurality of pulse blocks supply intermittent pulses of liquid to the hutch chamber. A dam is formed at the top of the screen. In operation, slurry is supplied to the lower portion of the bowl and forms a bed on the screen. A continuous flow of liquid is supplied axially inwardly from the hutch chamber through the screen and slurry bed. Liquid is also lightly pulsed from the hutch chamber axially inwardly through the screen and slurry bed. Under centrifugal, gravitational and liquid flow forces the denser particles migrate toward and through the screen and lighter particles migrate inwardly toward the axis of rotation. The denser particles pass through the screen into the hutch chamber and are collected on exiting from the discharge outlets. The lighter particles are carried over the dam and are collected separately.

28 Claims, 11 Drawing Sheets

METHOD AND APPARATUS FOR CONTINUOUSLY SEPARATING A MORE DENSE FRACTION FROM A LESS DENSE FRACTION OF A PULP MATERIAL

BACKGROUND OF THE INVENTION

The present invention relates to a method and apparatus for continuously separating fine or small particles contained in a fluid pulp or slurry according to density or specific gravity.

Elutriation, or rising current classification, is a method that is commonly used to separate particles in a pulp according to their settling rate. If particles of different size but of near equal density are placed in a container of static fluid, the larger particles will settle faster than the smaller particles. Conversely, if particles of near equal size but of different density are placed in a container of static fluid, the more dense particles will settle faster. If the fluid in the container is caused to flow upward through a downward settling stream of particles, the various settling rates are reduced by the velocity of the flow. Particles whose settling rates are less than the velocity of the fluid flow move upwardly and are separated from the particles whose settling rate is greater than the velocity of the flow. If particles are allowed to collect on a horizontal screen or sieve and subjected to an upward fluid flow that has a velocity that is near but lower than their settling rates, the particles will be agitated or fluidized by the flowing fluid and eventually reach equilibrium with the highest settling rate particles located nearest the screen or fluid source and the lowest settling rate particles located furthest from it. Such sorting processes are accentuated and accelerated when modified by additional forces generated by operation in a centrifuge.

Heavy media, or Sink-Float, Separation, as defined in Taggart, A Handbook of Mineral Dressing, John Wiley & Sons, Inc., NY, N.Y., 1945, page 11–104, is "subjection of a mixture of solid particles of different specific gravities to the buoyant actions of a quiescent body of fluid characteristics, having such density that it will float the lighter solid particles while the heavier sink, gravity being the only impelling force." In more simplified terms, it involves suspending the solid particles, which are to be separated according to density, in a liquid, the liquid having a density between that of the light particles and the heavy particles that are to be separated. For example, wood and rock may be separated by placing the mixture of wood particles, with a specific gravity of less than one, and rock particles, with a specific gravity greater than one, in a quiescent pool of water. The wood floats and the rocks sink, and the two materials are thus separated according to their density.

Heavy media separation relies on the "resultant density" of the materials to be separated. The resultant density is simply the difference between the actual density of the solid particles and the fluid that is used for separation. For example, if particle A, with a specific gravity of 3.0, were to be separated from particle B, with a specific gravity of 2.0, using a fluid with a specific gravity of 2.5, the resultant density of particle A would be +0.5 and that of particle B would be −0.5. The difference between the resultant densities is the same as that between the actual densities. In the example above the difference in resultant density is also one.

Known gravity recovery machines rely on combinations of the elutriation and sink-float principles under standard gravity. Besides machines named for the specific principle, others that are well known are sluices and jigs. All have been developed to work quite effectively with reasonably large particle sizes and reasonably large material density differences. They reach their limitations with small particles or small density differences.

As settling rates are affected by density or specific gravity, smaller particles may be separated more effectively and accurately in a centrifuge because of the increased difference between their resultant densities and consequent differences in settling rates.

When sink-float separation is performed in a centrifuge, the impelling force is increased because it becomes the resultant vector of centrifugal force and gravity. Differences in resultant density are accentuated accordingly and particle separation becomes more accurate and effective because of that increased difference. With the above particles placed in a centrifuge that applied a combined loading of 10 times gravity the resultant densities would increase proportionately to give a resultant density difference of 10.

Numerous centrifugal devices have been proposed to achieve fine particle separation. Unfortunately, all have their limitations. One of the first of these centrifugal devices was the Ainlay Bowl which in essence is a centrifugal sluice. Pulp material is fed into the center of a spinning bowl-shaped basin from a stationary pipe. That feed is then forced upward and outward along the inner surface by centrifugal force. Horizontal riffles placed on the inner surface collect gold and other dense minerals while the lighter materials are washed up to and discharged over the bowl periphery. Its operational principle is heavy media separation with fluidization provided by the turbulence caused by the pulp transport fluid passing over the riffles. Later adaptations provided additional turbulence with stationary baffles placed near the surface of the riffles to further agitate the transport fluid. Major problems with this device result from the insufficient and irregular fluidization provided by the transport fluid and the fact that the riffles quickly become filled with heavy minerals and cease to function effectively. When that happens, the unit must be shut down and cleaned or emptied, like any other sluice.

A more recent adaptation of the Ainlay Bowl consists of the addition of fluid through small holes through the side of the bowl in the riffle area. This adaptation introduces elutriation to the device and improves both recovery and concentrate quality by improving fluidization in the recovery area of the machine. Two machines that utilise this principle are currently being manufactured and are marketed under the names of the Knelson Bowl and the Falcon Super Bowl.

The above mentioned centrifugal machines are a major improvement over gravity recovery machines. Basically these machines are centrifugal sluices which operate under the principle of elutriation and must be periodically shut down and cleaned. This causes operational problems and essentially restricts their use to the separation of precious metals and other extremely valuable products. Undesirable material particles with high settling rates are recovered along with those that are desirable. Often this causes the riffles to fill too quickly and causes desired materials to be lost. They are also not effective in recovering extremely fine or small sized desirable particles and become ineffective when the density difference between desirable and non-desirable particles falls below a threshold.

U.S. Pat. No. 4,056,464 issued to Cross discloses a jig that utilizes a frusto-conical rotating rotor and screen made of woven wire mesh or perforated sheet metal for the concentration of heavy minerals. The screen is rotated in a chamber containing nominally stationary fluid. It is stated that the pulsations of a plunger along with centrifugal force created by the rotating rotor will cause a vortex to form above the co-axial container (screen) and that heavy minerals will pass through the screen for outside collection. The disclosed frusto-conical screen, as measured from the axis of rotation, would have to be of a low angle in order to create the stated vortex and cause the feed material to move outward and upward. If such a vortex were to form, the actual free surface of the fluid would be in the shape of a paraboloid of revolution about the axis of rotation and material would therefore be unevenly distributed along the surface of such a low angle screen. However, the drawings of the patent indicate that the basket and screen are set at approximately 45 degrees from the vertical axis. This would cause the particles to be subjected to widely varying centrifugal forces as they moved up the screen. Recovered product quality would therefore be virtually impossible to control.

U.S. Pat. No. 4,279,741 issued to Campbell discloses a centrifugal jig with a cylindrical screen. The jig is rotated to produce an outward centrifugal force that is substantially greater than the force of gravity on a slurry supplied to the jig. A liquid is pulsed inwardly from a hutch chamber to produce a fluidic bed within the rotating jig screen to permit settling and separation of the heavy fraction of the slurry from the lightweight fraction.

Campbell discloses that the fluid pulsing apparatus of FIGS. 1 to 5 may be adjusted to allow a selected amount of fluid seepage to the jig bed. Campbell also discloses an arrangement where fluid pulses are provided by rotating a hutch chamber having openings which periodically communicate with openings in a stationary pulsator.

U.S. Pat. No. 4,998,986 also issued to Campbell discloses an improvement to the fluid pulsing system by providing more abrupt shock waves or pressure pulses to the rotating hutch chamber of the jig. To create the pulses, continuously flowing pressurized fluid is alternately directed either to the interior space of the hutch chamber or to the interior space of a surrounding enclosure.

However, I have recognised that for the jig to function, the cylindrical screen would have to be extremely short along its Y or vertical axis, or it would have to be operated at extremely high speeds to generate extremely high centrifugal forces at the screen surface. Otherwise, fluid leaking over a dam would leave an area of the hutch chamber vacant of water and filled with air. That air filled area would then compress during the pulse phase and prevent the jig bed from being agitated.

U.S. Pat. No. 4,898,666 issued to Kelsey discloses a centrifugal jig that utilizes a deep bed of ragging retained by a parabolic shaped screen that separates the slurry supplied region from a hutch chamber. A small amount of water is continuously added to the hutch chamber to replace the water, not more than 5%, lost through the screen, and the bed is pulsed by the hutch chamber water which is driven by a mechanically actuated rubber diaphragm. In a second example, Kelsey discloses actuation of the pulsing diaphragm with compressed gas or by electromagnetic means. The jig has a high number of moving parts that would be difficult to lubricate properly in an environment where water and fine abrasive sand are abundant.

It remains desirable to develop a dependable apparatus that will effectively and continuously separate small sized dense particles from similar sized less dense particles in a pulp material.

SUMMARY OF THE INVENTION

In accordance with the present invention, apparatus for separating more dense particles from less dense particles contained in a slurry includes a rotary chamber with an inner wall separating outer and inner portions of the chamber and including a screen, means for rotating the chamber, a restricted outlet in the radial outer portion of the chamber for the more dense particles, a further outlet in the chamber inwardly of the screen for the less dense particles and liquid in which they are suspended, means for continuously supplying liquid to the outer portion of the chamber via elutriation inlet means in the outer portion of the chamber, the elutriation inlet means being in permanent registry with an outlet of a continuous liquid supply as the chamber rotates in use, and means for supplying pulses of liquid from a second liquid supply via pulse inlet means in the outer portion of the chamber. The present invention combines the principles of both elutriation and heavy media separation into a simple and easily operated, nominally single moving piece, centrifugal particle separation and recovery device.

The aforementioned problems are overcome by providing a separate continuous supply of liquid to the chamber in addition to a pulse supply. The slurry retained against the screen of the chamber is continuously fluidized and intermittently agitated to provide optimum separation of dense particles from light particles.

In accordance with a further aspect of the invention the screen comprises a plurality of vertically spaced rings of increasing radius and a plurality of bars, the bars being connected to the rings and extending from the lowermost to the uppermost ring, and the bars having a substantially wedge shape cross-section and being arranged with the widest part of the wedge adjacent to the rings. Such an arrangement of the bars prevents blinding of the screen because the spaces between the bars increase in size from within the screen to the outside of the screen, thereby allowing particles which pass through the screen apertures to be carried outwardly without obstructions. Furthermore the arrangement of the rings assists in holding the heavy media beds in position, the rings acting as retention rings.

DETAILED DESCRIPTION OF PREFERRED EMBODIMENT

Figure 1:
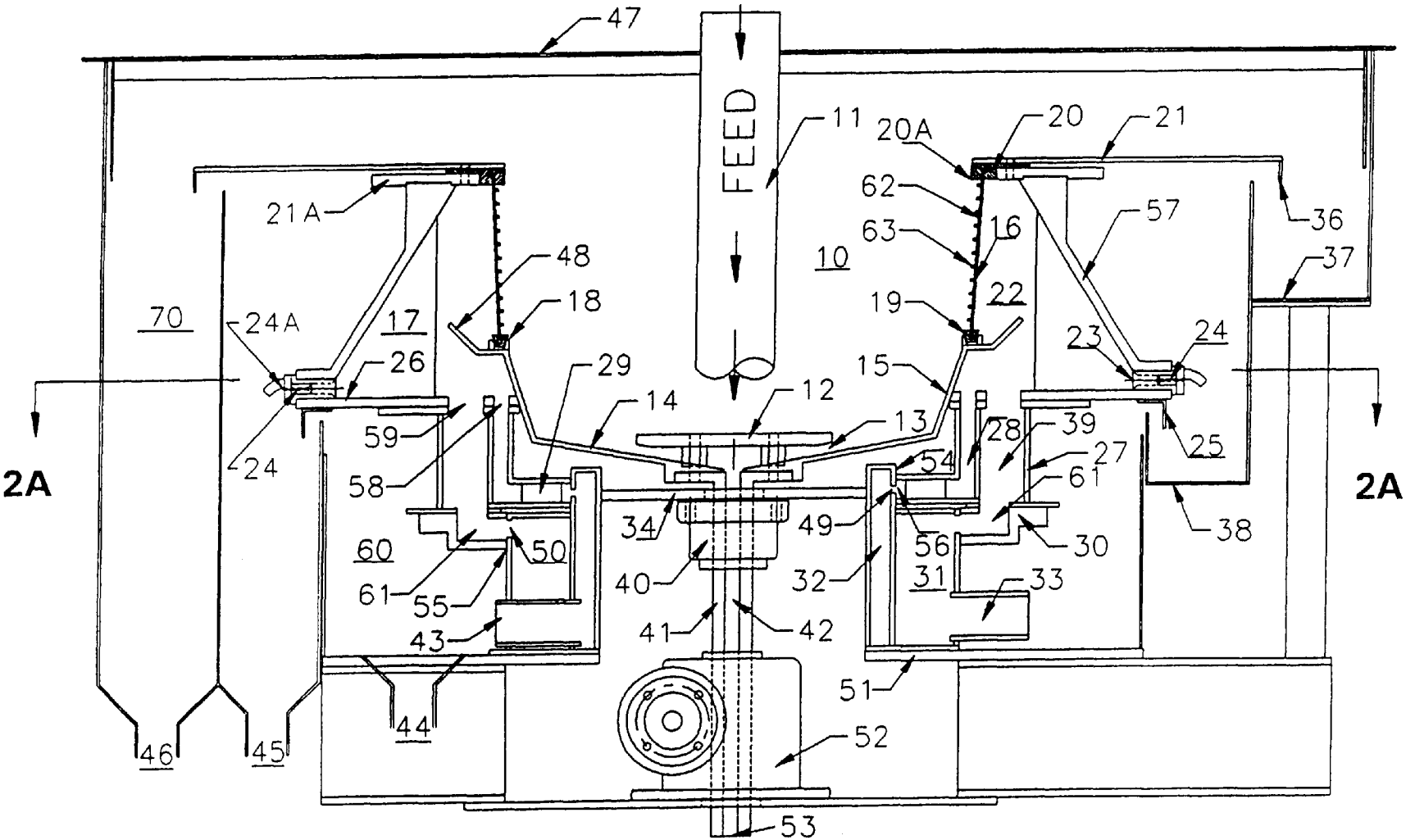
FIG. 1 is a sectioned side view of a preferred separating apparatus embodying the invention.

FIG. 1 shows a separating apparatus embodying the invention. The separating apparatus consists of two parts: a rotor assembly 10 and a stationary assembly 70. The rotor assembly 10 acts as a centrifuge and all the component parts must be either balanced or symmetrical. Slurry or pulp is fed into the rotor assembly 10 through a feed pipe 11 which passes through the top wall or lid 47 of the stationary assembly 70. The feed pipe 11 is suspended vertically above a feed plate 12 such that slurry entering the feed pipe 11 descends under gravity and falls onto the feed plate 12. The stationary feed pipe 11 may be supported by the stationary lid 47 or any other suitable means.

The rotor assembly 10 includes a rotary chamber which receives first and second supplies of liquid. The rotary chamber has an inner wall 14, 15, 16 separating outer and inner portions of the chamber. The inner wall is formed from a screen 16 and a bowl 14 and 15 with a central hole. The flat, circular feed plate 12 whose diameter exceeds that of the central hole in the bowl is centred at a distance above the central hole in the bowl to define an annular slot 13 communicating with the central hole. The bowl is stepped with an upper region 15 and a lower region 14. The lower region 14 is angled at approximately 80° to the vertical to ensure drainage through the slot 13 into the central hole when the rotor assembly 10 stops rotating. The angle of the upper region 15 of the bowl, as measured from the vertical or Y axis of the rotor assembly 10, must be equal to or slightly greater than the sum of the natural angle of repose of the solid particles contained in the pulp and the angle between vertical and the normal to the resultant vector of the centrifugal force and gravity, and therefore depends on the intended rate of rotation of the rotor assembly 10. The natural angle of repose of the solid particles is determined by rotating from a stationary state a quantity of the slurry in a centrifuge having a vertical axis, a horizontal floor and vertical walls, stopping rotation and allowing the solid particles in the slurry to settle under gravity alone. The angle of repose is then the angle between the horizontal and the sloping surface formed by the solid particles when the particles are at rest and completely submerged in the liquid component of the slurry. It is the result of interparticle friction when lubricated by the liquid and is determined by the surface characteristics of the particles and the lubrication capability of the liquid. It is normally about 18° for typical sand suspended in water, but should be measured in the laboratory for each application. Consequently, if the natural angle of repose of the solid particles contained in the pulp is 18° and the resultant force vector is 3° below horizontal, then the upper region 15 should be angled at approximately 21° to the vertical. It will be appreciated that the free surface defined by solid particles in the upper region 15 during operation will then be substantially parallel to the walls of the upper region 15 of the bowl.

In operation, the upper region 15 is completely covered by the fluid that comprises the liquid portion of the pulp. At the top of the bowl a deflector ring 48 has a horizontal part which supports a U-section ring 18 for seating the screen 16, and an outer part which slopes upwardly at an angle of approximately 45° to the horizontal.

A seal 19 is fitted to the bottom of the screen 16. The seal 19 locates the bottom of the screen 16 on the bowl by fitting into the U-section ring 18. The U-section ring 18 and the seal 19 are designed to minimise turbulence that might be caused as the already partially separated pulp material flows past that joint and might cause it to again become mixed. A second seal 20 is fitted to the top of the screen 16. The second seal 20 is fastened between a tailings ring 21 and a top ring 21A by bolts which pass through equiangularly spaced holes in the tailings ring 21, through corresponding holes in the second seal 20 and thread into corresponding threaded holes located in the top ring 21A. The tailings ring 21 is annular and the inner perimeter finishes flush with the inner upper edge of the second seal 20. The tailings ring 21 extends horizontally outwardly terminating at its outer perimeter in a circular drip ring 36 which is positioned vertically above a tailings launder 37 provided in the stationary assembly 70. The circular drip ring 36 protrudes downwardly from the tailings ring 21 and helps to prevent tailings fluid from escaping the tailings launder 37. The second seal 20 is wider than the screen 16 and protrudes inwardly from the top of the screen to form a lip, or dam, 20A. The bottom face of the top ring 21A is fastened to an outer wall 57 of the rotary chamber which slopes downwardly and outwardly at an angle of approximately 59° to the horizontal.

The outer wall 57 of the rotary chamber terminates slightly short of where it would meet a bottom wall 26. The bottom wall 26 of the rotary chamber is horizontal and extends outwardly from the sloping upper region 15 of the bowl to which it is fixed by any suitable means.

Figure 2A:
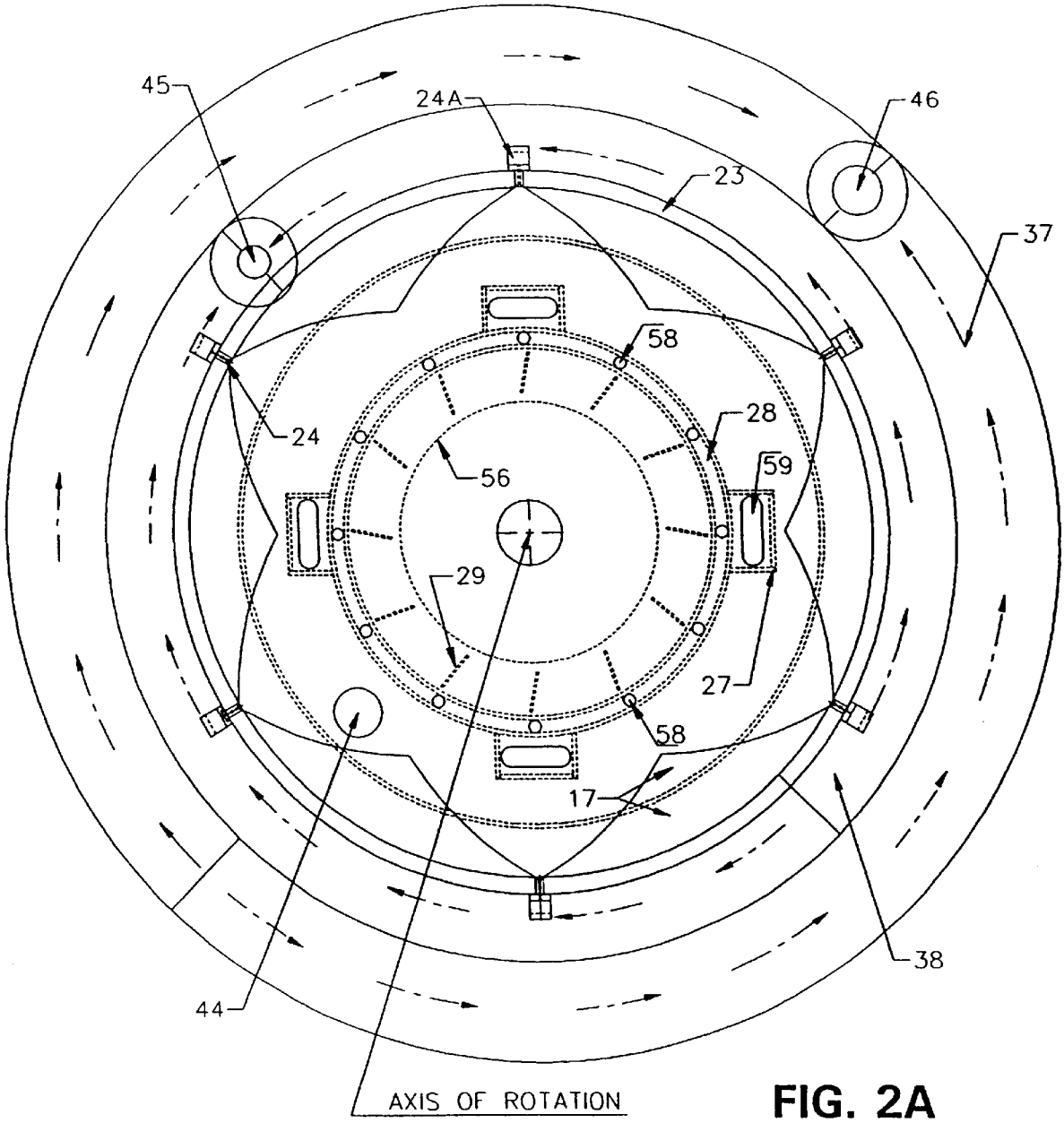
FIG. 2A is a horizontal section on line 2A—2A of FIG. 1.
Figure 2B:
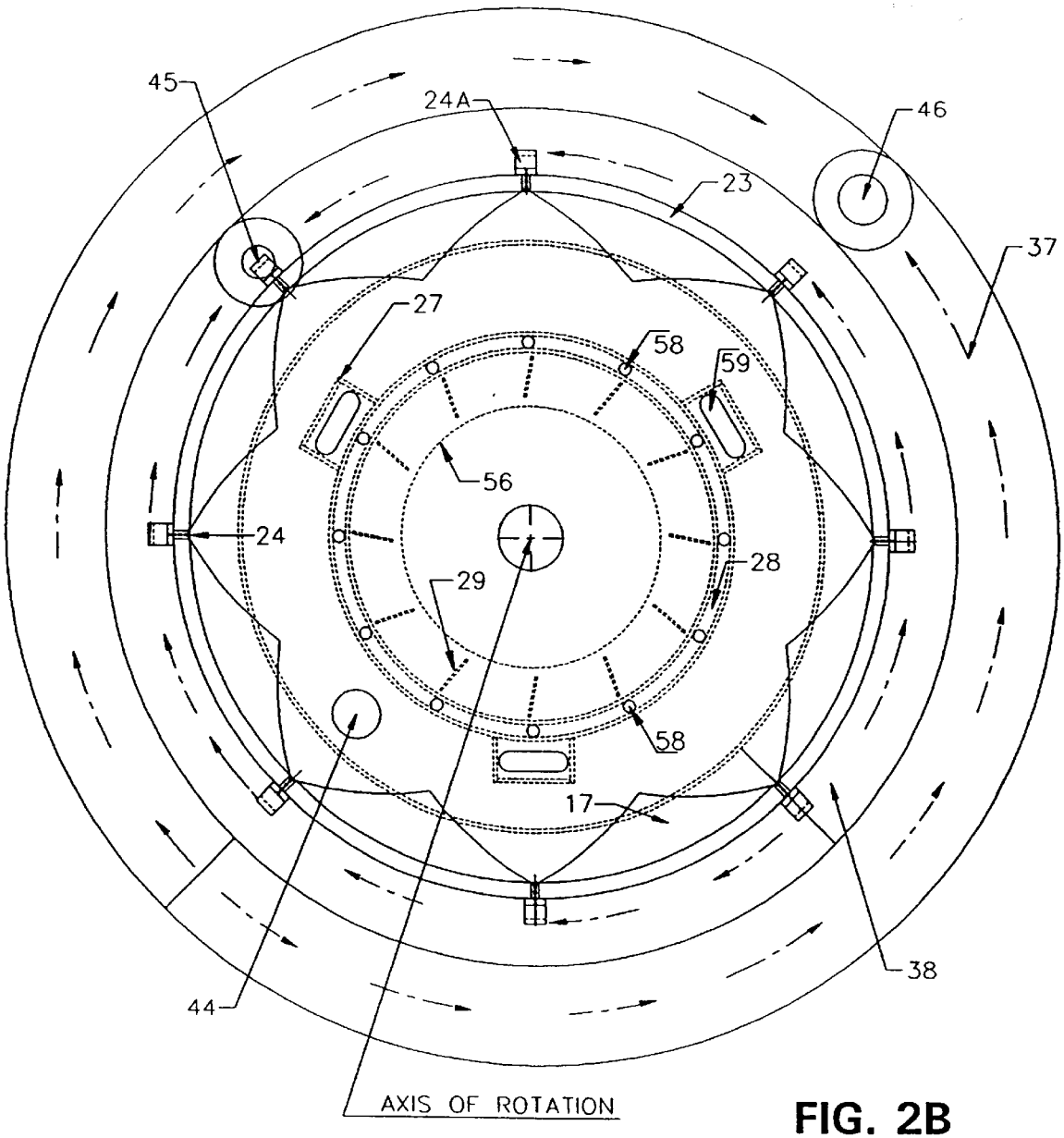
FIG. 2B is a variant of FIG. 2A.

A hutch chamber 22 is defined between the bottom and outer walls 26 and 57 and the screen 16. The outer wall 57 and bottom wall 26 of the hutch chamber 22 are fixed to opposite faces of an annular ring 23. Equiangularly spaced hutch fluid discharge ports 24 extend through the ring 23 to provide passageways between the interior of the rotary chamber and the exterior. FIG. 2A illustrates an embodiment with 6 hutch discharge ports 24. FIG. 2B illustrates an embodiment with 8 hutch discharge ports 24.

Figure 8C:
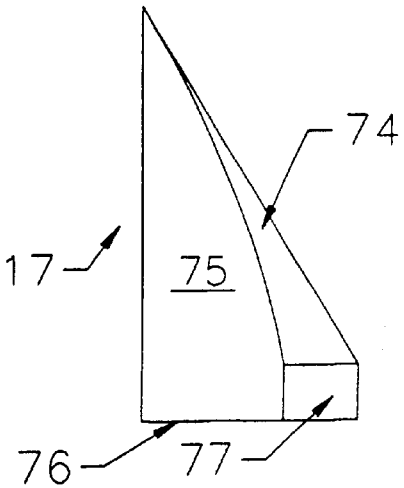
FIG. 8C is a side view of the insert of FIG. 8B.
Figure 8A:
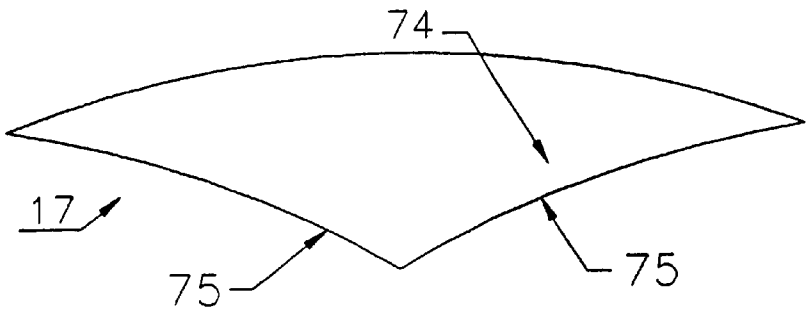
FIG. 8A is a plan view of a hutch chamber insert.
Figure 8B:
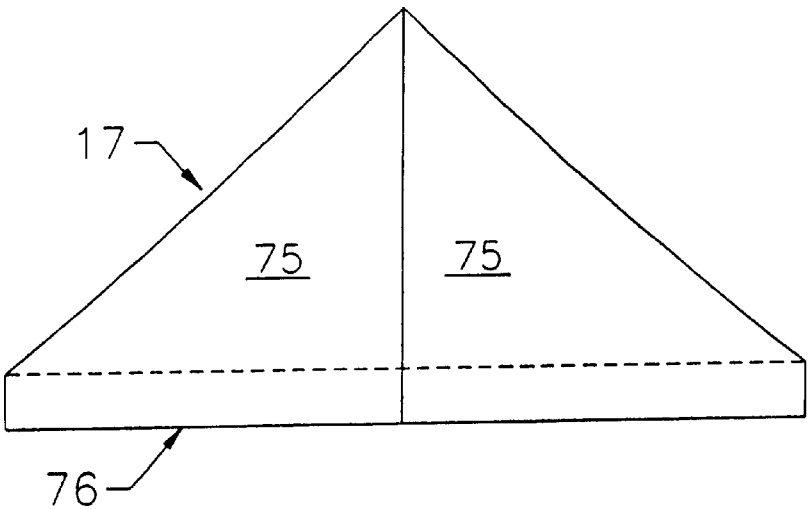
FIG. 8B is a front view of the insert of FIG. 8A.

A plurality of inserts 17 are interposed in the hutch chamber 22 between adjacent hutch discharge ports 24. The shape of an insert 17 will be appreciated from FIGS. 8A, B and C. The rear wall of each insert 17 has a curved portion 74 which fits flush against the outer wall 57 of the hutch chamber 22, and a part cylinder portion 77 that fits flush against the ring 23. The bottom wall 76 of each insert 17 is flat and fits flush against the bottom wall 26 of the hutch chamber 22. The curved portion 74 of the insert 17 may be attached to the outer wall 57 by any suitable means. The bottom wall 76 of the insert 17 may be attached to the bottom wall 26 of the hutch chamber 22 by any suitable means. Each interior face 75 of each insert 17 is part of a vertical, right circular cylindrical surface such that when the hutch chamber 22 is rotated solid material within the hutch chamber which travels radially outwardly and downwardly hits the interior face 75 of the insert 17. The interior face 75 of the insert is curved to present a substantially constant angle, $\beta$, between the normal to a radius from the axis of rotation of the apparatus and the tangent at the point on the face 75 at which the radius intersects the face 75. An angle of $\beta$=30° has been found to be suitable for most applications. The slope, $\gamma$, of the outer wall 57 is discussed below.

At each hutch port 24, the curved interior face 75 of each insert 17 meets the curved outer wall 57 of the rotary chamber. The material that has passed through the screen 16 is, therefore, directed to the hutch discharge ports 24. The angle, $\alpha$, between the tangent to the interior face 75 of the insert 17 and the tangent to the outer wall 57 at the point of intersection of the outer wall and the interior face must be equal to or slightly greater than the difference between the natural angle of repose, $\theta$, of the material and the angle between the vertical and the normal to the resultant force vector. For example, if the natural angle of repose of the material $\theta=18°$ and the resultant force vector is at $-3°$ to the horizontal, then $\alpha=15°$.

The slope of the inserts may be determined from the following equation:

$$\text{SIN}\ \alpha=(\text{SIN}\ \beta)\times(\text{SIN}\ \gamma)$$

where $\alpha$ is as defined above, $\beta$ is as defined above, and $\gamma$ is the slope of the outer wall 57. In the above examples, $\beta=30°$ and $\gamma=31°$ are found to be suitable values. Thus $\beta$ and $\gamma$ may be fixed for any given $\alpha$ and changing $\beta$ requires a change in $\gamma$ or vice versa.

Figure 9A:
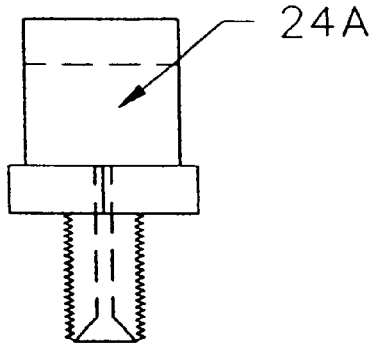
FIGS. 9A, 9B and 9C are, respectively, a plan view, an elevation and a side view of the structure of a hutch port liner and deflector.
Figure 9B:
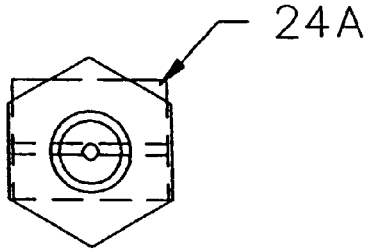
Figure 9C:
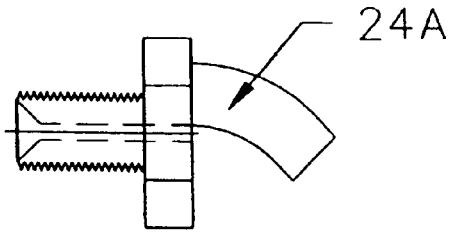

The number of hutch discharge ports required depends on the amount of heavy material that is expected to be recovered by the apparatus and the shape and size requirements of the inserts 17. The hutch discharge ports 24 are preferably drilled to a larger diameter than needed and threaded so that an easily replaced liner of abrasion resistant material may be threaded into them. The details of construction of a suitable liner are illustrated in FIGS. 9A, B and C. The liner is preferably fabricated from abrasion resistant stainless steel and has a curved deflector 24A. The liner is positioned within the hutch port 24 such that the deflector 24A curves downwardly and radially outwardly from the top of the hutch port. The deflector 24A dissipates the stream of concentrate material passing through the hutch discharge port 24 to a concentrate launder 38 and helps to prevent irregular wear of the wall of the concentrate launder and the concentrate material from hitting the outer wall of the concentrate launder at a point where some of the concentrate material may be inadvertently splashed into the re-circulation launder 60. A circular drip ring 25 protrudes downwardly from the outward edge of the bottom wall 26 and is positioned vertically above the concentrate launder 38 and helps to prevent concentrate liquid from escaping the concentrate launder 38. Each liner, when fully screwed into the respective hutch discharge port 24, extends about half way through the ring 23. The entrance to each liner is coned as illustrated in FIGS. 9A, 9B and 9C.

Figure 7A:
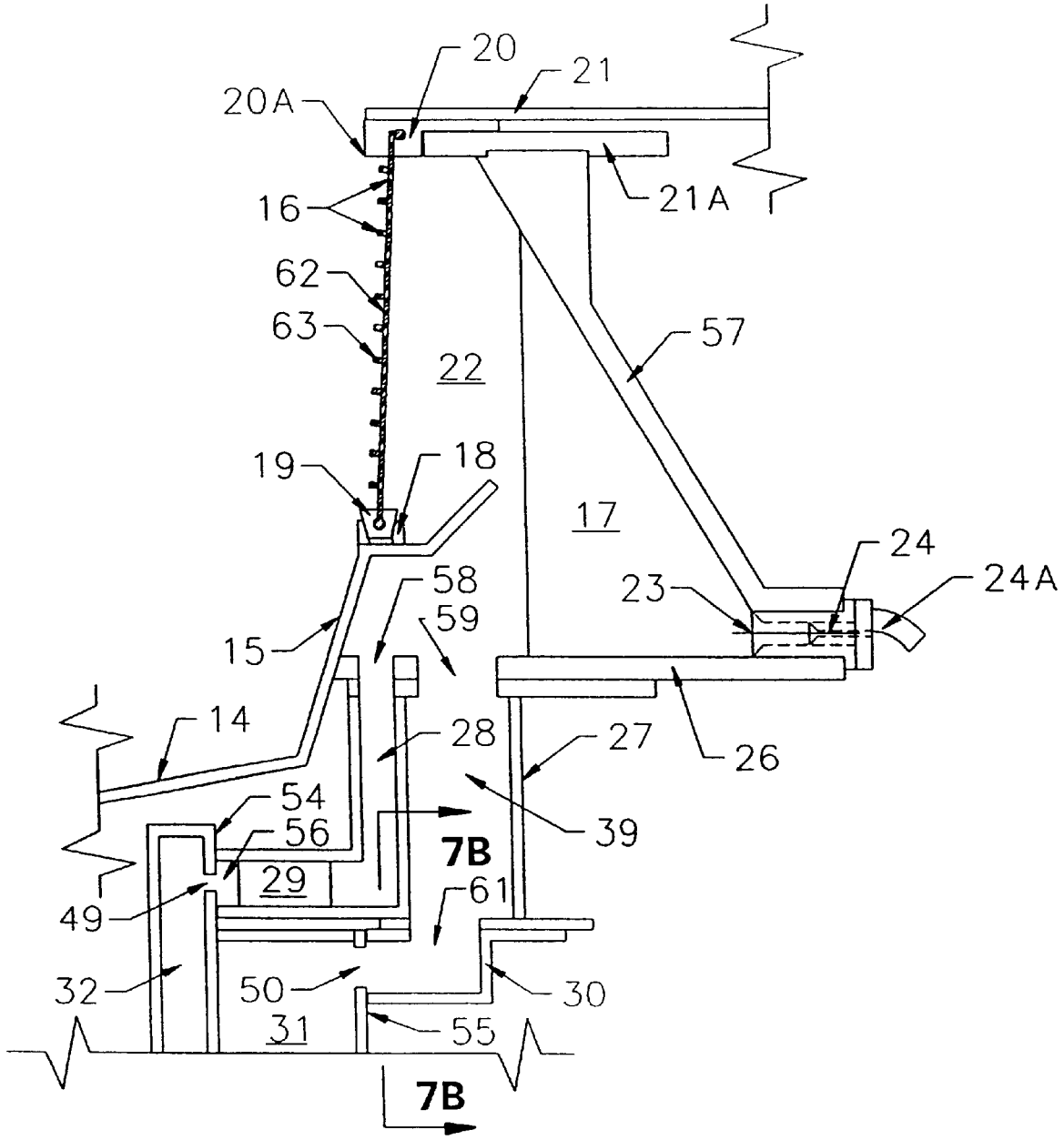
FIG. 7A is a sectional view showing in more detail some of the components of FIG. 1.
Figure 7B:
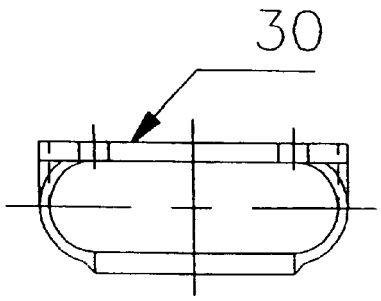
FIG. 7B is a section on Line 7B—7B of FIG. 7A showing the pulse block.
Figure 7C:
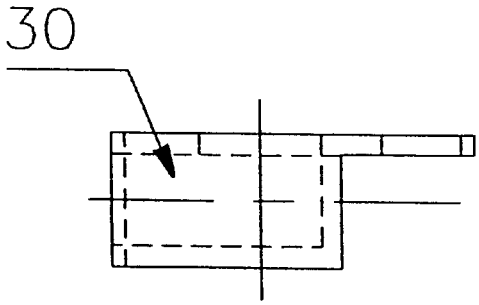
FIG. 7C is a side view of the pulse block of FIG. 7B.
Figure 7D:
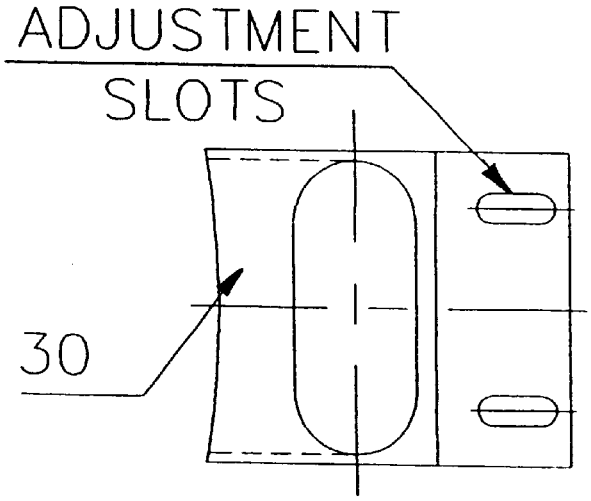
FIG. 7D is a plan view of the pulse block of FIG. 7B.

The entrance to the hutch discharge port 24 will preferably be coned as illustrated in FIG. 7A to facilitate full cleaning and discharge of recovered dense material. Heavy materials are discharged from the rotor assembly 10 through the hutch discharge ports 24 into the stationary concentrate launder 38.

In the bottom wall 26 of the hutch chamber 22, different pluralities of first and second hutch chamber inlet ports 58 and 59 are arranged in concentric circles centred on the axis of rotation of the rotor assembly, with the first hutch chamber inlet ports 58 forming the innermost circle as indicated in FIG. 2A.

A hollow drive shaft 41 extends vertically upward, terminating in an angled flange which is fixed onto the lower region 14 of the bowl around the central hole. Rotation of the drive shaft 41 therefore causes the rotor assembly 10 to rotate at the same speed as the drive shaft 41.

Figure 3:
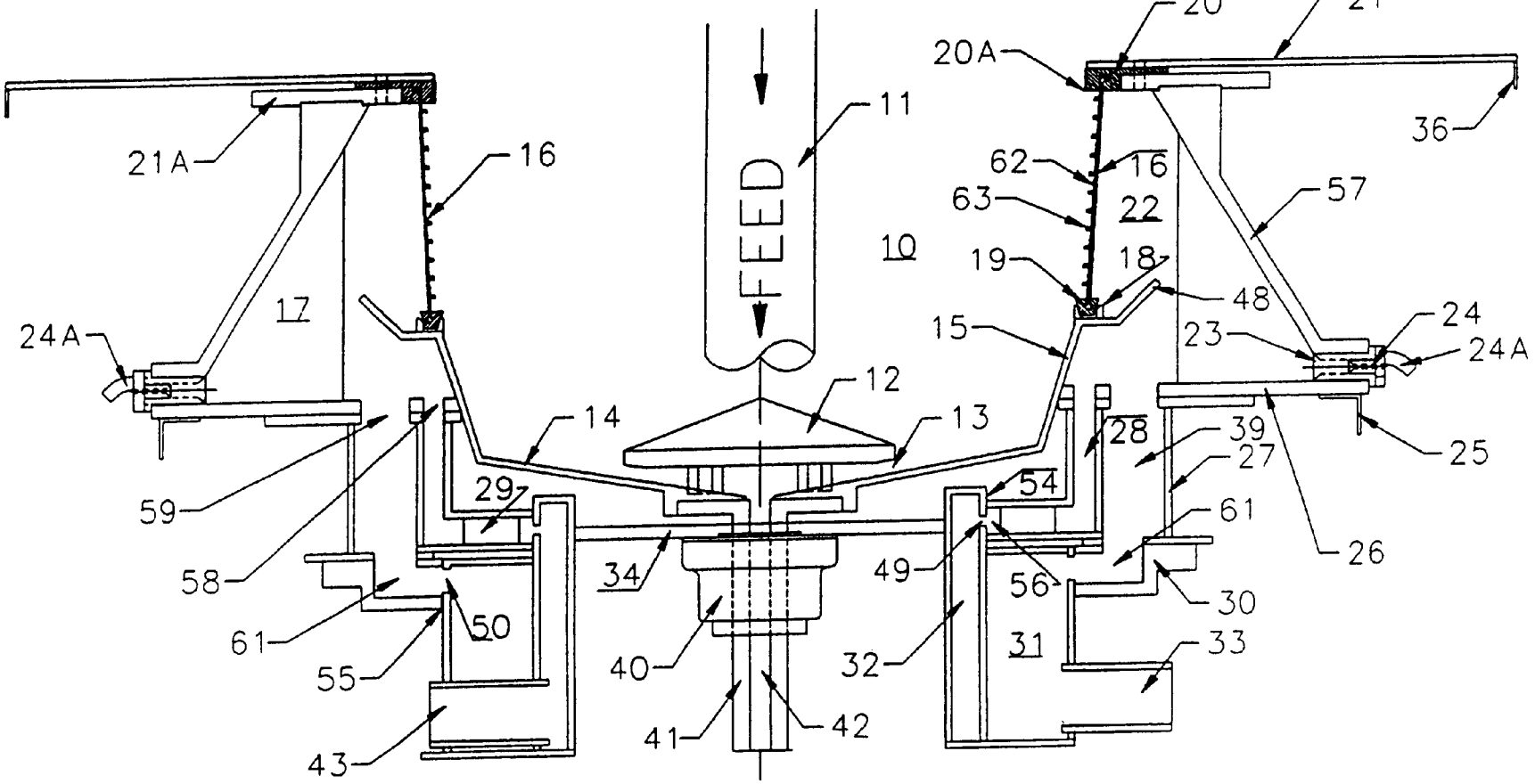
FIG. 3 is a sectioned side view of a rotor assembly and fluid manifolds of a preferred embodiment having a conical feed plate.
Figure 4:
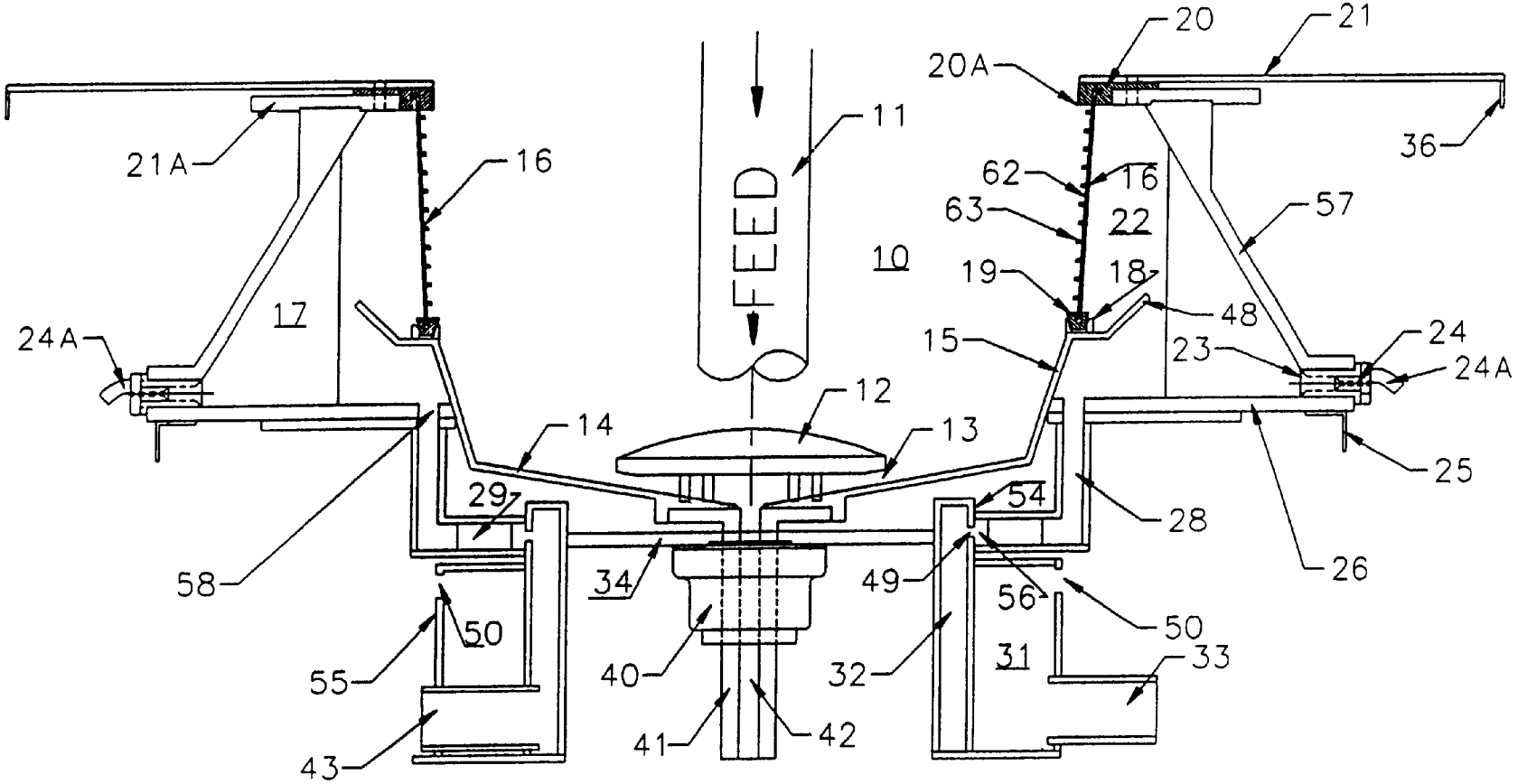
FIG. 4 is a sectioned side view of a rotor assembly and fluid manifolds of a preferred separating apparatus when the pulse block inlets are fully out of registry with the fluid manifold discharge ports and a convex feed plate is used.

The feed plate 12 may be a simple circular flat plate as shown in FIG. 1, conical as shown in FIG. 3 or any other balanced convex geometrical shape, one example of which is shown in FIG. 4. The feed plate 12 must not include any vanes or other protrusions. When a slurry is accelerated using vanes, the solid particles separate from the slurry and collect along the leading surfaces of the vanes, causing the solid particles to be discharged unevenly from the radially outer ends of the vanes.

Four holes extend through the feed plate 12. On the upper side of the feed plate 12 the holes are preferably countersunk to accommodate the heads of bolts preventing he bolt heads from being worn by feed material. A gap is maintained between the lower region 14 of the bowl and the circular feed plate 12 by spacers. Each spacer is cylindrical and has an axial through-hole. A respective bolt is passed thought each hole in the feed plate 12 and its head is accommodated in the countersunk hole. A spacer is passed over the shank of the bolt. The shank of the bolt extending below the spacer is passed through a corresponding hole in the lower region 14 of the bowl. The threaded end of the bolt is screwed into a screw threaded hole in the flanged end of the drive shaft 41. The feed plate 12 is therefore also rotated with the drive shaft 41.

Below the hutch chamber 22, an annular chamber 28, which is L-shaped in vertical section and is open at the free ends of the L-shape, is attached at the open end of the vertical limb of the L-shape to the bottom wall 26 of the hutch chamber 22 at the same radius from the axis of rotation as the first hutch chamber inlet ports 58. The open end of the vertical limb of the annular chamber 28 communicates with the hutch chamber 22 via the first hutch chamber inlet ports 58.

A plurality of vertical passageways 39 of rectangular cross-section are spaced equiangularly around the annular chamber 28. The passageways 39 are open at both ends. Each passageway 39 is attached at its upper end to the bottom wall 26 of the hutch chamber 22 at the same radius from the axis of rotation as the second hutch chamber inlet ports 59 and is aligned with a respective one of the ports 59 so that the upper end of the passageway 39 communicates with the hutch chamber 22. The lower end of each passageway 39 abuts a respective pulse block 30. The upper face of the pulse block 30 is attached to the lower end of the passageways 39. The radially inner, vertical face of the pulse block 30 is curved and is machined to a close fit with an outer face 55 of a stationary pulse fluid manifold chamber 31. The machining tolerance is preferably not more than +/−0.005 inches. Concentrically placed pulse port holes 50 pass through the pulse fluid manifold face 55 to allow liquid to freely pass out of the pulse fluid manifold chamber 31 and either exit freely into a re-circulation launder 60 or be captured by a chamber 61 in one of the pulse blocks 30. The interface between the pulse fluid manifold face 55 and the pulse blocks 30 defines pulse inlet means where the holes 50 communicate with respective openings in the radially inner vertical faces of the pulse blocks 30. To minimise leakage from this interface, it is desirable to place the pulse blocks 30 tightly against the pulse fluid manifold face 55 and allow them to wear together so that they fit closely and form some degree of seal. It is therefore desirable to fabricate them from materials with different resistance to abrasion. For example, the pulse blocks 30 may be made from plastic or aluminium or even wood, while the pulse fluid manifold face 55 may be made from steel or some more abrasion and corrosion resistant alloy thereof.

The stationary assembly 70 includes the lid 47, the tailings launder 37, the concentrate launder 38, the re-circulation launder 60, a chamber 32 for supplying a continuous supply of liquid, the chamber 31 for supplying liquid to the pulse blocks 30, and a bearing 40 with a bearing support plate 34. The bearing 40 supports the drive shaft 41. The rotor assembly 10 is thus supported by and held within the stationary assembly 70 by the bearing 40. There may be more than one such bearing, and the bearings may be of any type but must be capable of supporting the static weight of the rotor assembly 10 and allowing it to rotate freely within the stationary assembly 70. The bearing support plate 34 is annular and is attached to the bearing 40. The chamber 32 for supplying a continuous supply of liquid is annular, coaxial with the drive shaft 41 and closed at both ends by annular end walls. The perimeter of the bearing support plate 34 is connected for support to the inner cylindrical wall of chamber 32 by any suitable means.

An inlet pipe 43 to the chamber 32 is provided on an outer cylindrical wall 54 at a position near the base of the chamber 32. The inlet pipe 43 is in turn attached to a source (not shown) of continuous liquid supply.

A ring of equiangularly spaced holes 49 runs horizontally around the entire circumference of the outer cylindrical wall 54 of the chamber 32 close to the top of the chamber 32. The annular chamber 28 presents an annular slot-like opening 56 at the free end of its horizontal limb, which faces the top of the outer cylindrical wall 54 of the chamber 32. The diameter of the each hole 49 is less than the height of the opening 56 of annular chamber 28. The centres of the holes 49 are located at the same height as the vertical midpoint of the opening 56 so that the holes 49 communicate with opening 56. The interface between the chambers 28 and 32 defines elutriation inlet means where the holes 49 communicate with the opening 56. Liquid entering the chamber 32 from the inlet pipe 43 is forced upwardly in the chamber 32 and out of the holes 49 where it passes into the annular chamber 28 by way of the slot-like opening 56. No seal is provided between the holes 49 and horizontal limb of the annular chamber 28, and the chamber 32 and the annular chamber 28 are placed in extremely close proximity without actually touching. Liquid seepage is minimised by machining the outer cylindrical wall of the chamber 32 and the free end of the horizontal limb of the annular chamber 28 very precisely to tight tolerances.

Flat vanes 29 are provided within the lower, horizontal limb of the annular chamber 28. Each vane 29 spans the entire height and a proportion of the length of the lower, horizontal limb of the annular chamber 28 and is set at an angle of approximately 10° to the direction of flow of liquid entering the limb to centrifugally accelerate the liquid in the horizontal limb.

The pulse fluid manifold chamber 31 is coaxial with the drive shaft 41, formed around the outside of the chamber 32, and closed at both ends by annular end walls. The lower end of the pulse fluid manifold chamber 31 is located flush with the lower end of the chamber 32. The pulse fluid manifold chamber 31 is shorter axially than the chamber 32 and is spaced from the bottom of the annular chamber 28. Near the base of the pulse fluid manifold chamber 31 an inlet pipe 33 is attached and communicates liquid from the source (not shown) of continuous liquid supply. This source (not shown) is the source to which the inlet pipe 43 is connected. Near the top of the pulse fluid manifold chamber 31 are the holes, or pulse ports 50, which are equiangularly spaced on the pulse fluid manifold chamber 31.

In operation, when the pulse ports 50 are aligned with the pulse blocks 30 liquid flows from the pulse fluid manifold chamber 31 into the hutch chamber 22 and when the pulse ports 50 and the pulse blocks 30 are out of alignment the liquid in the pulse fluid manifold chamber 31 flows into the re-circulation launder 60 where it is collected and returned to the liquid supply. The re-circulation launder 60 is an annular chamber which surrounds the chamber 32 and pulse fluid manifold chamber 31 and has an outlet pipe 44 in its base.

Surrounding the re-circulation launder 60 is the annular concentrate launder 38 and surrounding the annular concentrate launder 38 is the tailings launder 37. The tailings launder 37 and concentrate launder 38 each have floors that slope helically down in both directions from a ridge to an outlet pipe 46 or 45 at the lowest point of the tailings launder 37 or concentrate launder 38 respectively. The ridges are diametrically opposite the outlet pipes 45 and 46 as indicated in FIG. 2A. Alternatively, the tailings launder 37 and concentrate launder 38 may simply have a sloping bottom provided by inserting into the launders a flat, elliptical plate at an angle to the horizontal.

In both FIG. 2A and 2B, the first hutch chamber inlet ports 58 are holes equiangularly displaced around the bottom wall 26 of the hutch chamber 22. The second hutch chamber inlet ports 59 are elongate slots formed through the bottom wall 26 of the hutch chamber 22. FIG. 2A shows four second hutch chamber inlet ports 59. FIG. 2B shows a second embodiment with only three second hutch chamber inlet ports 59. The number of second hutch chamber inlet ports 59 depends on the number of pulses that are desired per revolution of the assembly and the volume of liquid that can practically be transmitted into the hutch chamber through available pulse blocks.

Operation of the preferred embodiment will now be described. The rotor assembly 10 is rotated by applying power to the axially located drive shaft 41 via a shaft mounted speed reducer 52. Power to the speed reducer 52 may be supplied by an electric motor and V-belts (not shown) or by any other suitable means.

Initially, liquid is supplied through the inlet pipes 33 and 43 and fills the hutch chamber 22 from which it escapes through the hutch discharge ports 24 and the screen 16. The liquid, which preferably is water, does not fill up the bowl 14 and 15 but is driven centrifugally over the dam 20A and the tailings ring 21 to the tailings launder 37.

The separating apparatus continuously receives a pulp or slurry composed of mixed density solid particles conveyed in a liquid, and separates them into a more dense, or heavier, fraction and a less dense, or lighter, fraction. The slurry or pulp is fed into the separating apparatus through stationary feed pipe 11. The slurry descends under gravitational force, exits the feed pipe 11 and falls onto the feed plate 12 of the rotor assembly 10.

Figure 6:
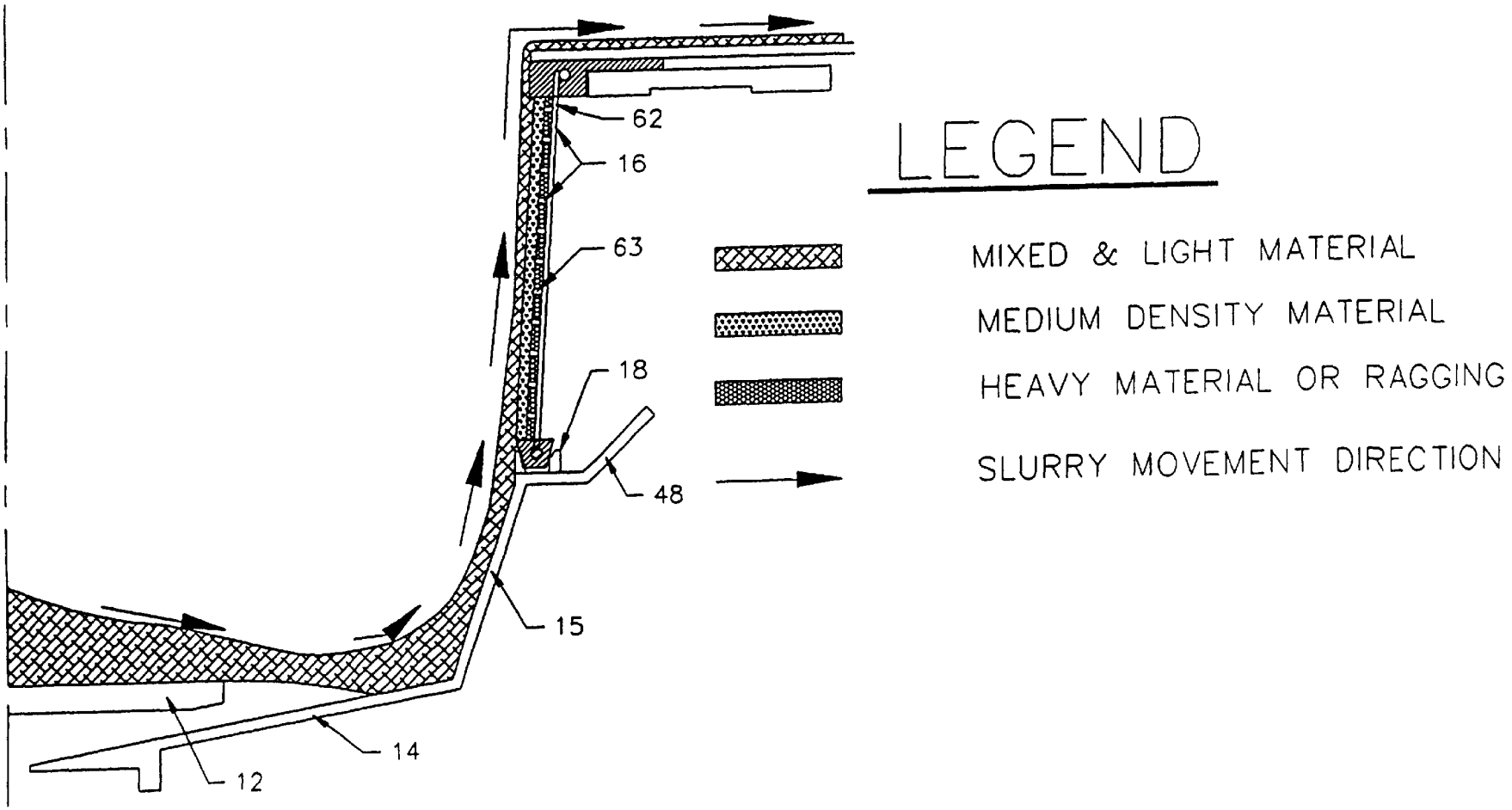
FIG. 6 a schematic sectional view of part of the bowl of FIG. 1 illustrating the separation of materials of various densities as they pass across the screen.

The slurry is accelerated outwardly from the spinning feed plate 12 and subsequently strikes the lower region 14 of the bowl. Under centrifugal force the slurry accelerates outwardly and up the side of upper region 15 of the bowl. The slurry is subjected to increasing outwardly directed force as it travels upwardly along the upper region 15 of the bowl under the combined action of centrifugal force and additional slurry entering the rotor assembly 10 from the feed pipe 11. At the upper region 15 of the bowl, heavier particles migrate towards the surface of the bowl, displacing lighter particles, so that the particles are arranged in a layer with the heaviest against the surface of the bowl and the lightest nearest the axis of rotation, as illustrated in FIG. 6.

Particle separation occurs principally on, and radially inward from the internal surface of screen 16. The slope of the inverted frusto-conical screen 16 is extremely critical and must be determined separately for each individual application because uniform elutriation can only be achieved if the heavy media bed depths are constant over the axial length of the screen. Any pressure variations caused by the use of the disclosed steep walled inverted frusto-conical screen quickly become equalized by locally more dense fluid or are too small to be significant, so long as the screen slope is correctly determined.

Preferably, the free surface of the fluid passing upwardly over the screen 16 and the dam 20A should be normal to the resultant force vector of centrifugal force, acting along the horizontal X-axis, and gravity, acting along the Y-axis. To maintain a nearly constant separation bed thickness, it is preferable that the screen 16 should slope at the same angle to the horizontal as the chord of that portion of the parabolic curve then followed by the free surface. If $\phi$ is the angle between the fluid surface and the horizontal it can be calculated for each point along the curve as follows $$\tan \phi=\omega^2 r/g$$

where $\omega$ is the angular velocity of the rotor, g is the acceleration due to gravity and r is the radius to any point on the free surface from the axis of rotation.

Assuming the radius of the screen 16 at the dam 20A is 12 inches and that the dam 20A is 0.5 inches high, then r=11.5 inches and $\phi$=87° when $\omega$=250 rpm.

However, when the angular velocity of the rotor, $\omega$, is slow or if the screen is extremely long so that the radius from the axis of rotation to a point on the screen changes significantly over the length of the screen, the following equations provide a better estimate of the slope angle $\phi'$ of the screen.

Assuming additionally that H is the vertical height in inches of the dam 20A above the point where the slope of the notionally extended parabolic free surface would become zero and cross the axis of rotation, R is the radius in inches measured from the axis of rotation to the dam 20A, h is the height of any point on the screen 16 above the point where the notionally extended parabolic free surface would intersect the axis of rotation so that (H−h) is the vertical height in inches of the screen, and r is the radius of the point on the notionally extended parabolic free surface from the axis of rotation so that (R−r) is the difference between the radius of the notionally extended parabolic free surface at the dam 20A and at the point at height h, then $$H-h=K(R^2-r^2)\omega^2$$

where K is a constant, $K=1.4208\times10^{-5}$ for $\omega$ in revolutions per minute and linear measurements in inches.

Assuming R=11.5 inches and $\omega$=250 RPM then the point where the notionally extended parabolic free surface would intersect the axis of rotation, that is where r=0, gives H=117.44 inches. Further assuming that the frusto-conical screen 16 is to be 8 inches high, then at the bottom of the screen the radius (of the free surface) r=11.1 inches and (R−r)=0.4 inches such that from trigonometry $$\text{Tan } \phi'=(H-h)/(R-r)$$

and $\phi'$=87°.

In the above example, assumptions were made for the values of H, R and $\omega$. In practice, the choice of R is governed by the need to generate a sufficient centrifugal force at reasonable angular velocities. Suitable values for some applications have been found to be R=11.5 inches and $\omega$=250 RPM as given. The upper limit for R is determined by the practical size limit of the overall apparatus. The choice of screen height is dependent on the size of the screen apertures and the amount of material that is to be passed through the screen. Screen manufacturers often provide empirical data for calculation of the necessary amount of open area to pass a given volume of material. Based on that empirical data and once a suitable radius R has been chosen, the height of the screen may be calculated.

Figure 5B:
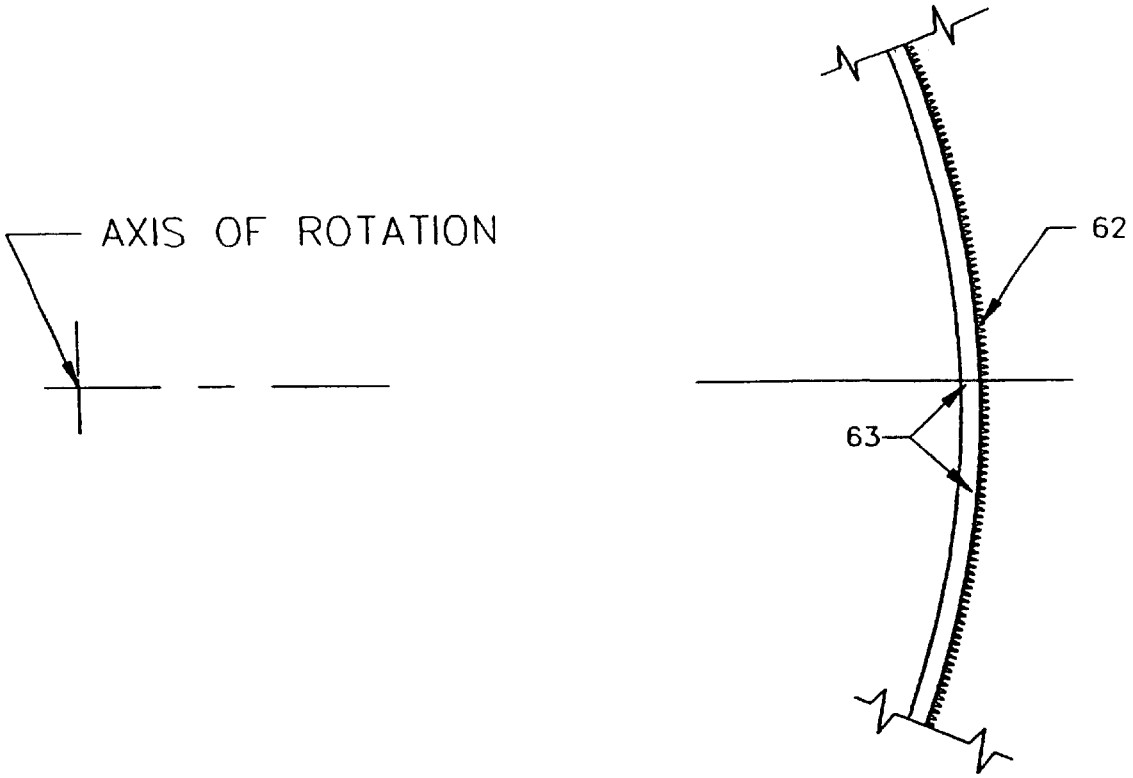
FIG. 5B is a partial plan view of the frustoconical screen of FIG. 5A.
Figure 5A:
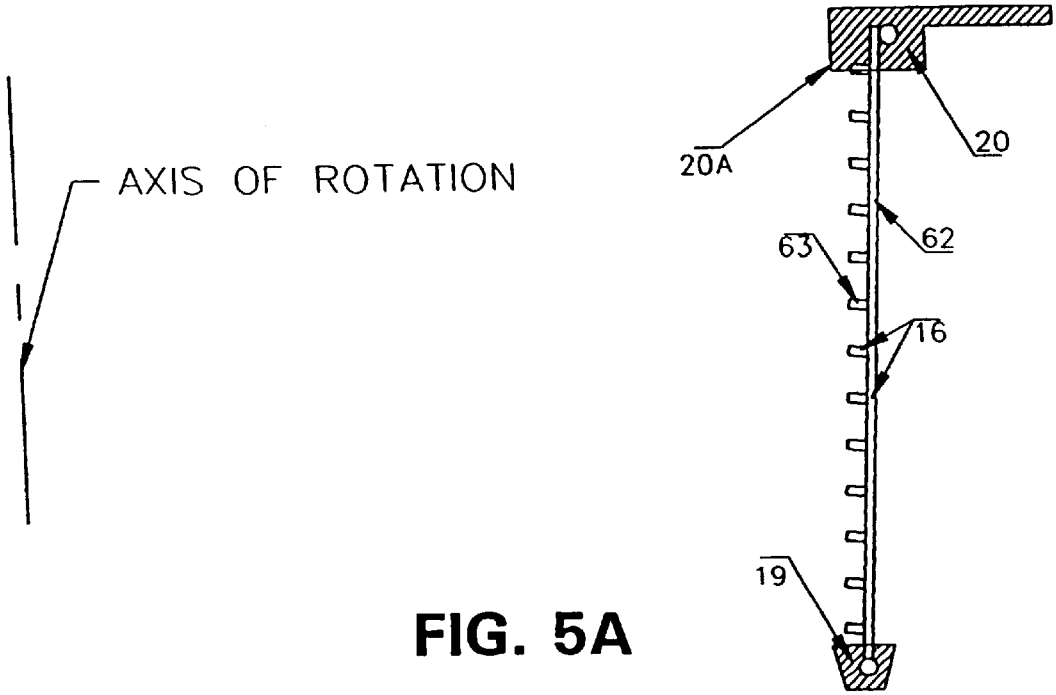
FIG. 5A is a detailed sectional view of the frustoconical screen of FIG. 1.

The preferred inverted frusto-conical screen 16 may be constructed of any acceptably strong filtering material or structure with a sufficient amount of open area to allow the desired amount of liquid to pass through it and the desired amount of heavy material to pass radially outwardly through it. FIGS. 5A and 5B show the preferred embodiment of the screen 16. Nearly vertical metal bars or rods 62 are supported and retained in position by approximately horizontal rings 63 of rectangular or round cross-section, the vertical bars 62 and horizontal rings 63 being welded together. The horizontal rings 63 are arranged to act as retention rings to assist in holding a heavy media bed in position. The vertical bars 62 are a triangular or wedge shape in cross section and are placed with one side facing toward the interior side of the screen to minimize "blinding" of the screen. Alternatively, the vertical bars 62 are trapezoidal in cross section and are attached to the horizontal rings by the longest parallel side. In the presently preferred embodiment, the interface between the horizontal rings 63 and the vertical bars 62 defines the apertures of the screen 16. The number of vertical bars is many times greater than the number of horizontal bars in the preferred embodiment, and the apertures are vertical slots whose width is substantially many times narrower than their length. It is, therefore, the spacing of the vertical bars which is important when designing the screen because, generally, the heavy particles to be separated from the slurry are approximately regular in shape and the critical dimension of an aperture is the horizontal distance between edges of the adjacent vertical bars 62. Blinding is caused when near aperture size particles stick or hang in the apertures. Since the gap between adjacent vertical bars 62 is constantly expanding in size in the outward direction, once a particle has cleared through the critical width of an aperture, it will freely pass through the remaining portion of the gap between the adjacent vertical bars 62.

The presently preferred method of fabrication of the screen 16 will now be described. The screen 16 is fabricated in flat sections which are subsequently cut, rolled and welded together to form the desired frusto-conical shape. Preferably either two or three flat sections are machined to form the screen 16. Horizontal bars of rectangular or circular cross-section are placed substantially parallel to each other. Vertical bars 62 of triangular or wedge shape cross-section are placed substantially perpendicular to the horizontal bars. One side of each bar 62 is welded to one side of the horizontal bars to form a flat lattice section with uniform apertures defined between the bars 62 and horizontal bars. Each flat lattice section is cut into a shape approximating a trapezoid but differing in that the cut lattice section has arcuate, instead of straight, parallel sides. The approximately trapezoidal lattice sections are rolled by a frusto-conical roller. The rolled lattice sections are arranged to form a frusto-conical screen and lattice sections are welded together.

According to an optional feature of operation of an embodiment of the invention a thin layer (4 to 5 particle diameters thick) of dense spherical or spheroid shaped particles of a large enough diameter to not pass through the screen apertures may be held by centrifugal action directly on the radially inner side of a coarse-aperture inverted frusto-conical screen 16. The voids between the particles forming the layer act as the aperture of a fine mesh, but non plugging, barrier to prevent fine particles of middle weight material from reaching or passing through the screen 16. Heavy fine particles pass through the layer and the screen to be collected. When the layer is pulsed, any slurry or pulp particles that may decrease the screening efficiency because their size is near that of the voids, are rejected with the light fraction or collected with the heavy fraction.

The slurry is forced to flow in an upward (axial) direction across the screen 16 by both centrifugal force and the displacing flow of additional slurry from the feed pipe 11. As the slurry flows across the screen 16, solid particles settle outwardly toward the screen under the action of centrifugal force. At the same time, liquid flows continuously radially inwards through the screen 16 from the hutch chamber 22. The liquid from the hutch chamber 22 acts as an elutriation medium to prevent light material particles from settling against the screen 16, and assists in rejecting them into the "tailings" stream flowing over the surface of the tailings ring 21. The liquid continuously flowing inwards also agitates "medium weight" or middling particles that may either exist naturally in the pulp, or be artificially added for the specific purpose of creating a bed of medium or middling specific gravity fluid in the area immediately radially inside the screen 16. That bed will act as a heavy media or sink-float layer to prevent light material from passing through while allowing heavy material to penetrate to, and reach the screen. In addition, the bed can be subjected to light pulses of water from the pulse fluid manifold chamber 31, as discussed below, to agitate the bed further and thereby further assist in the separation of the light and heavy particles. The pulses are kept sufficiently light to prevent loss or distortion of the heavy media bed.

The stream containing the light fraction of product or "tailings", will pass over the dam 20A. The radial extent of the dam 20A, as measured perpendicularly from the screen 16, defines the total depth of a series of beds that are retained on the inverted frusto-conical screen 16 and is determined by the process requirements for each type of slurry that is to be separated. From the dam 20A, the pulp moves radially outwardly along the top of the tailings ring 21 until it is discharged from the rotor assembly 10 into the stationary tailings launder 37. The circular drip ring 36 prevents light products from entering the concentrate launder 38. The tailings launder 37 directs the pulp containing the light product in helical paths, as indicated by the arrows in FIG. 2A, until it reaches the discharge opening 46 and exits from the apparatus.

Two principles are used in material separation in the separating apparatus. The first is the use of centrifugal force, created by rotating the rotor assembly 10, which accentuates the progress of fine dense particles toward and eventually through the inverted frusto-conical screen 16 and to the perimeter of the rotor assembly 10. The second is elutriation, in which the action of the flowing liquid, preferably water, inhibits the settling of light particles.

The flowing liquid is also used to agitate and cause to be fluidized a bed of heavy media, thereby allowing sink-float separation to occur.

Liquid is provided from an external source (not shown). Preferably the external source is a low pressure, high volume, centrifugal pump. Liquid enters the separating apparatus through the inlet pipe 43 and through the inlet pipe 33. The volume of flow to each pipe is controlled by separate valves (not shown) prior to each inlet pipe. Both the exterior face 54 of the chamber 32 and the pulse fluid manifold face 55 of the pulse fluid manifold chamber 31 are cylindrical and preferably machined to a tolerance of no more than +/−0.005 inches. The chamber 32 and pulse fluid manifold chamber 31 are always stationary and are attached to a support ring 51. The support ring 51 is preferably attached to the interior cylindrical wall or side of the chamber 32 and, through the chamber 32 and the bearing support plate 34 supports the attached bearing 40 that in turn supports and permits rotation of the entire rotor assembly 10. The centering provided by the engagement of the bearing 40 and the shaft 41 holds annular chamber 28 and pulse block supports 27 within accurate tolerance of the exterior face 54 and the pulse fluid manifold face 55 respectively.

An important feature of the embodiment is that the radial distance of the interface between the exterior face 54 of chamber 32 and the annular chamber 28, which defines the elutriation inlet means, from the axis of rotation of the rotor assembly 10 must be substantially less than the radial distance of the notionally extended free surface of the pulp material held against the screen 16 from the axis. With that condition satisfied, the resultant static head under the resultant centrifugal load of the liquid that is contained in the vertically extending portion of the L-section annular chamber 28 will always exceed the resultant static head that is exerted against the screen 16 and consequently against the fluid that is contained in the hutch chamber 22. For example, if the dam 20A has a radius from the axis of rotation of 11.5 inches, the dam has a height of ½ inch from the screen 16, there is a vertical height of 17 inches from the dam 20A to the bottom of the vertical portion of annular chamber 28, the heavy media bed has a specific gravity of 3.0, and the rotor assembly 10 is rotated at 250 RPM, then the notionally extended free surface of the pulp material held against the screen has a maximum radius of 10.635 inches from the axis of rotation. The pressure exerted by the heavy media bed against the screen is a function of the pressure of water, the specific gravity, and combined centrifugal and gravitational loading and the depth of the fluid bed which will equal the height of the dam 20A from the screen 16. Assuming a combined centrifugal and gravitational loading of approximately 20 G's the heavy media bed would exert a pressure of at least 1.1 PSI against the screen 16. Note that the above numbers are approximate because they do not take into account the increased depth of pulp material, measured in the radial direction, that is the result of feed rate and is therefore variable. The slot-like opening 56 of the chamber 28 for this example must therefore have a radius of at least 2 inches less than the maximum extended free surface radius or, in the above example, less than 8.6 inches. Any liquid that is discharged from the chamber 32 through the holes 49 and enters into the annular chamber 28 will therefore be forced to flow into the hutch chamber 22. During operation, there will always be a free liquid surface and a pocket of air contained in the horizontal portion of the chamber 28. This feature permits liquid to be added to the hutch chamber 22 without the need for a rotational fluid seal and allows easy regulation of the volume of liquid flow with an exterior valve (not shown).

Liquid may only exit from the hutch chamber 22 by flowing through the hutch discharge ports 24 whose flow rates will be constant for a given rotational speed (or centrifugal loading) or by flowing radially inwardly through the frusto-conical screen 16. Thus the velocity of the liquid flow through the frusto-conical screen 16 can be controlled easily by simple regulation of the flow to the annular chamber 28, and hence by controlling flow from the continuous liquid supply to the chamber 32.

The annular chamber 28 continuously conveys liquid from the holes 49 directly to the first hutch chamber inlet ports 58 to the hutch chamber 22. Any liquid that exits from holes 49 and does not enter the annular chamber 28 will simply spill into the re-circulation launder 60 and flow to the outlet pipe 44.

Liquid from the pulse fluid manifold chamber 31 provides surges of low pressure water to further agitate the heavy media bed at screen 16 as needed. A further feature of this embodiment is that the radius of the interface between the pulse fluid manifold face 55 and the pulse blocks 30, which defines the pulse inlet means, must be slightly more than that of the notionally extended free surface of the pulp material that is held against the screen 16, but must be less than the actual minimum radius of the frusto-conical screen 16. Thus back pressure from the centrifugal load on the liquid contained in the hutch chamber 22 is maintained at all times against the interface between the pulse blocks 30 and the pulse fluid manifold face 55 to prevent air from entering the passageways 39. At the same time, the resultant static fluid pressure head must not be high enough to inhibit the entry of liquid delivered from the pulse ports 50 into the pulse blocks 30. The low resultant head or pressure is also important to minimise leakage around the interface between the pulse blocks 30 and the pulse fluid manifold face 55. A valve (not shown) is provided in the inlet pipe 33 to allow simple adjustment of the volume of the pulses. Pulsing may not be required for certain applications and instead of continual pulsing, intermittent bursts of pulses may be desired. A second valve (not shown) installed on the inlet pipe 33 and operated by a timer may be used to reduce the frequency of the bursts of pulses by permitting flow for only a few seconds every few minutes as required for the specific application.

It is possible to shut off, or reduce, the continuous flow of liquid to the pulse fluid manifold chamber 31 without reducing the performance of the separating apparatus because the interface between the pulse fluid manifold chamber 31 and the pulse block 30 is chosen to lie as closely as possible to the notionally extended free surface of the pulp material that is contained on the screen. The resultant pressure is therefore minimised at the interface of the pulse blocks 30 and pulse fluid manifold chamber 31 and the liquid is substantially retained in the pulse blocks 30. Any liquid which does seep out of the pulse blocks 30 is replaced by liquid from the hutch chamber 22 which is continuously supplied via the chamber 32. Solid materials which pass through the screen 16 are directed away from the second hutch chamber inlet ports 59 by deflector ring 48. Thus, solid particles are prevented from exiting the hutch chamber 22 via the second hutch chamber inlet ports 59. Consequently the separating apparatus may be used effectively and efficiently for applications where no pulsing or more limited pulsing is required.

If in addition to the measurements used in the above example, the vertical distance from the dam 20A to the bottom level of the pulse blocks 30 is 19 inches and the maximum screen radius and resultant maximum free surface radius is assumed to be 11.5 inches then the maximum radius of the notionally extended free surface of the pulp would be approximately 10.53 inches at that point, and the liquid pressure against the interface and consequent minimum pressure in the pulse fluid manifold chamber 31 would be approximately 1.1 PSI above atmospheric pressure.

Any number of pulse ports 50 may be placed in the pulse fluid manifold face 55 so long as they are equally spaced around the circumference of the pulse fluid manifold face 55 to maintain the balance of the rotor assembly 10. It is not necessary that the pulse arrives at all points in the hutch chamber at the same time. It is, however, important that the pulse is balanced and that sufficient liquid is injected into the hutch chamber to agitate the entire bed. The pulse blocks 30 and the corresponding passageways 39 and second hutch chamber inlet ports 59 must be equiangularly spaced so that all come into communication with the pulse ports 50 at the same time. Liquid from pulse ports 50 which are not in registry with the pulse blocks 30 flows freely into the re-circulation launder 60 and exits from the device through the outlet pipe 44. A sufficient volume of liquid must be delivered from the pulse blocks 30 to the hutch chamber 22 during an extremely short period of time. For example, if the rotor assembly 10 rotational speed is 250 RPM, a pulse displacement (at the screen) of 0.25 mm is desired, the screen area is 4,000 $cm^2$, the pulse fluid manifold face 55/pulse block 30 interface radius is 30 cm, and the effective pulse block 30 opening slot is 8 cm long, then a volume of 100 $cm^3$ of liquid must be injected into the hutch chamber 22 from the pulse blocks 30 during a time period of approximately 10 milliseconds. It would be impractical, if not impossible, to open an orifice, cause that volume of liquid to accelerate from rest, flow through, and then decelerate to rest during such a short time period.

The basic requirements for each of the pulse blocks are that it should consist of a chamber whose rotationally spaced boundaries can pass through the flowing stream of liquid without unduly disrupting the rate of flow, and that between those walls, it should have a slot or opening with a vertical extent which is greater than the diameter of the pulse ports 50 and a horizontal extent sufficient to capture the desired amount of liquid during the period of time throughout which the entrance opening of the pulse blocks 30 are in registry with the pulse ports 50. One possible form of a pulse block 30 is illustrated by FIGS. 7A to 7D. The rotation of the pulse blocks 30 around the pulse fluid manifold face 55 allows the capture of the desired volume of liquid from the already flowing stream by the diversion of it into the desired location during the available period of time, and then by the disconnection of it allowing the stream to continue flowing freely. In operation, the entrance openings of each pulse block 30 simultaneously register with one each of the pulse ports 50.

The primary agitation action in the separating apparatus is the elutriation effect of the continuous flow of liquid as it passes radially inwardly from the hutch chamber 22 through the screen 16 and through the slurry.

The pulses in the present separating apparatus must not be so severe as to disrupt the fluid bed or beds, or to cause the heavy media material to be ejected from the bed or beds and lost into the tailings or light material stream. For the separating apparatus to function properly, all pulsed liquid must be allowed to flow freely. All passages must therefore be carefully designed to remain of constant size or to increase in size from the pulse fluid manifold face 55 towards the hutch chamber 22.

A further feature of the separating apparatus is that the outer part of the deflector ring 48 is frusto-conical and is disposed immediately behind the screen 16 and in front of the second hutch chamber inlet ports 59. Its purpose is to deflect any directional water pulses that enter the hutch chamber 22 and to cause the pulses to be reflected off the outer wall 57 and bottom wall 26 of the hutch chamber 22 and dissipated as much as possible before impacting with the frusto-conical screen 16, further protecting the heavy media bed or beds from disruption during agitation. A second benefit of the deflector ring 48 is that it assists in deflecting and directing heavy material that passes outwardly through the screen 16, as discussed below, toward the hutch discharge ports 24 and away from the second hutch chamber inlet ports 59.

As previously discussed, heavy particles move under the combination of centrifugal, gravitational and fluid flow forces, pass through the hutch current flowing into the inner portion of the rotary chamber and heavy media beds, and eventually reach the inverted frusto-conical screen 16. Heavy particles that are smaller than the screen apertures pass through the screen 16 and enter the hutch chamber 22, where they continue to move under increasing centrifugal force until they reach the annular ring 23. At the ring 23 the heavy particles are drawn through a hutch discharge port 24 and are discharged into the concentrate launder 38.

The concentrate launder 38 collects all heavy particles that are discharged into it and delivers them to the outlet pipe 45 as indicated by the arrows in FIG. 2A. From that point, they exit from the centrifugal concentrator.

If coarse material is retained in or on the inverted frusto-conical screen 16 because the particles are larger than the screen openings, it may be desirable to recover that heavy media material, or other valuable particles such as gold, that are retained thereon. In that case, the flow of slurry through the feed pipe 11 may be momentarily shut off and, as soon as the inner wall 14, 15 and 16 of the rotary chamber has cleared itself, the rotation of the rotor assembly 10 may be slowed or stopped. The liquid flow to the hutch chamber 22 is left on or may be reduced somewhat as desired. As soon as the rotor assembly 10 has stopped, or its rotational speed has reduced to the point where the material that was retained in the screen is not held there by centrifugal force, material is washed out of the screen 16 by the liquid flowing from the hutch chamber 22 through the screen 16 and falls into the lower region 14 of the bowl. It is then washed down the lower region 14, under the feed plate 12, through the annular slot 13, down the interior 42 of the hollow drive shaft 41 and into a container (not shown) that may be placed under the end 53 of the drive shaft 41.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

I claim:

1. An apparatus for separating more dense particles from less dense particles contained in a slurry, comprising:

a) a rotary chamber with an inner wall separating outer and inner portions of the chamber, the inner wall including a screen;

b) a first liquid supply means;

c) a second liquid supply means;

d) a drive arrangement for rotating the chamber relative to the first and second liquid supply means;

e) a feed arrangement for supplying slurry to the inner portion of the chamber;

f) a radial outlet in the outer portion of the chamber for dense particles passed by the screen;

g) a further outlet defined by the chamber inwardly of the screen for the less dense particles and liquid in which they are suspended;

h) an elutriation inlet to the outer portion of the chamber for receiving a continuous supply of liquid from the first liquid supply means and establishing an elutriation flow through the screen; and i) a pulse inlet to the outer portion of the chamber for receiving pulses of liquid from the second liquid supply means.

2. An apparatus according to claim 1, wherein the radial distance by which the elutriation inlet is spaced from the axis of rotation is less than the spacing of the screen from the axis of rotation.

3. An apparatus according to claim 2, having a plurality of vanes between the elutriation inlet and the outer chamber to accelerate the flow of the elutriation liquid from the continuous supply.

4. An apparatus according to claim 1, wherein the radial distance by which the pulse inlet is spaced from the axis of rotation is equal to or less than the spacing of the screen from the axis of rotation.

5. An apparatus according to claim 1, wherein the second liquid supply means comprises a continuous supply of liquid under pressure, and the pulse inlet is adapted to communicate intermittently with the second liquid supply means during rotation of the chamber.

6. An apparatus according to claim 1, wherein the elutriation inlet is in permanent registry with an outlet of the first liquid supply means as the chamber rotates in use.

7. An apparatus according to claim 1, wherein the screen of the inner wall of the chamber comprises:

a) a plurality of rings spaced apart along a common vertical axis, the radii of the rings decreasing from an uppermost ring to a lowermost ring;

b) a plurality of rods of substantially trapezoidal cross section arranged outside the rings, one surface of each rod being attached to each one of the plurality of rings at equal intervals along the length of one side of said ring to define screen apertures, the rods being spaced equidistant apart to define a continuous constant width slot between the rods.

8. An apparatus according to claim 7, wherein the screen is substantially frusto-conical.

9. An apparatus according to claim 1, wherein said further outlet comprises a ring-shaped dam at one end of the screen.

10. An apparatus for separating more dense particles from less dense particles contained in a slurry, comprising:

a) a rotary chamber with an inner wall separating outer and inner portions of the chamber, the inner wall including a screen;

b) liquid supply means;

c) a drive arrangement for rotating the chamber relative to the liquid supply means;

d) a feed arrangement for supplying slurry to the inner portion of the chamber;

e) a radial outlet in the outer portion of the chamber for the more dense particles which pass through the screen and the liquid in which they are suspended;

f) a further outlet defined by the chamber inwardly of the screen for the less dense particles and liquid in which they are suspended;

g) an inlet to the outer portion of the chamber for receiving a continuous supply of elutriation liquid from the liquid supply means;

h) a surface in said outer portion of the chamber to direct the elutriation liquid to effect elutriation at said screen; and i) an accelerating structure for radially accelerating the elutriation liquid from the liquid supply means to the said inlet.

11. An apparatus according to claim 10, wherein a radial distance by which the inlet is spaced from the axis of rotation is equal to or less than the spacing of the screen from the axis of rotation.

12. An apparatus according to claim 10, wherein a plurality of vanes between the inlet and the outer chamber accelerate the elutriation liquid from the continuous liquid supply.

13. An apparatus according to claim 10, wherein the screen of the inner wall of the chamber comprises:

a) a plurality of rings evenly spaced apart on one common vertical axis, the radii of the rings decreasing from an uppermost ring to a lowermost ring;

b) a plurality of parallel rods of substantially trapezoidal cross section arranged outside the rings, the wider parallel surface of each trapezoidal rod being attached to each one of the plurality of rings at equal intervals along the length of one side of said rod to define screen apertures, the rods being spaced equidistant apart to define a continuous constant width slot between the rods.

14. An apparatus according to claim 10, wherein the screen is substantially frusto-conical.

15. An apparatus according to claim 10 wherein said further outlet comprises a ring-shaped dam at one end of the screen.

16. A centrifugal separator apparatus for separating more dense particles from less dense particles in a slurry, comprising:

a rotor assembly; and a stationary assembly supporting said rotor assembly, said rotor assembly comprising:

a bowl open upwardly to receive a supply of slurry;

a hutch chamber surrounding said bowl and having a ring of peripheral discharge outlets;

a vertical rotary drive shaft coupled to said bowl for rotating said bowl with said hutch chamber about a vertical axis;

said bowl comprising a lower impermeable portion coupled to said drive shaft, an upper impermeable portion connected to said lower portion, and a frusto-conical screen, said screen forming an inner wall of said hutch chamber and being mounted on said upper portion;

a feed plate mounted to a central region of said lower portion of the bowl to receive said supply of slurry and distribute said slurry centrifugally in the bowl;

an annular liquid inlet for supplying elutriation liquid continuously to the interior of said hutch chamber;

and a plurality of liquid inlet conduits for supplying pulses of liquid to the interior of said hutch chamber;

said bowl further comprising a dam at an edge of said screen remote from said upper portion, and said lower portion defining a liquid outlet below said feed plate;

and said stationary assembly comprising:

a device for applying rotary drive to said rotary drive shaft;

a support for supporting said rotary assembly; and an annular liquid chamber coaxial with said rotary drive shaft and comprising a supply for continuously supplying elutriation liquid to said annular liquid inlet, said annular liquid chamber further comprising a plurality of supply output ports disposed for intermittent communication with said plurality of liquid inlet conduits during rotation of said rotor assembly.

17. An apparatus as claimed in claim 16, wherein said annular liquid chamber comprises non-communicating inner and outer annular chambers having respective liquid supply inlets, one of said annular chambers having a supply output arranged for continuous communication with said annular liquid inlet, and the other of said annular chambers comprising said plurality of supply output ports.

18. An apparatus according to claim 1, wherein said radial outlet comprises a plurality of radial outlet ports, and wherein a removable liner is provided within each said radial outlet port.

19. An apparatus according to claim 18, wherein a curved deflector extends downwardly and radially outwardly from the radial outer end of the liner.

20. An apparatus according to claim 1, wherein said radial outlet comprises a plurality of radial outlet ports, and inserts are located in the outer portion of the rotary chamber between adjacent radial outlet ports, each insert having a rear face contoured to fit the outer portion of the chamber, and opposed interior faces, each interior face describing an arc of the surface of a cylinder, the opposed interior faces of each insert intersecting the outer portion of the chamber at adjacent radial outlet ports.

21. A method of separating particles suspended in a slurry according to particle density comprising the steps of:

a) supplying slurry to an inner portion of a rotating chamber to form a layer of slurry on the inner surface of the screen separating the inner portion of the chamber from an outer portion of the chamber;

b) supplying a continuous flow of elutriation liquid to the outer portion of the chamber; and c) radially accelerating the continuous flow of elutriation liquid at its entrance to the outer portion of the chamber.

22. A method of separating particles suspended in slurry according to particle density comprising the steps of:

a) supplying slurry to an inner portion of a rotating chamber to form a layer of slurry on the inner surface of a screen separating the inner portion of the chamber from an outer portion of the chamber, b) supplying liquid in pulses to the outer portion of the chamber to pulse liquid from the outer portion of the chamber inwardly through the screen and layer of slurry thereon whilst allowing denser particles which pass outwardly through the screen to enter the outer portion of the chamber and allowing the less dense particles and liquid in which they are suspended to escape over the screen from the inner portion of the chamber;

c) simultaneously supplying a continuous flow of elutriation liquid to the outer portion of the chamber separately from the liquid in pulses; and d) directing the elutriation liquid through the screen from the outer portion of the chamber to the inner portion of the chamber to effect elutriation at the screen.

23. A method according to claim 22, wherein supplying liquid in pulses comprises allowing an outlet of a continuous supply of liquid to register intermittently with an inlet to the chamber.

24. A screen for use in apparatus for separating more dense particles from less dense particles contained in a slurry including a rotating chamber, the screen comprising:

a) a plurality of rings evenly spaced apart along a common vertical axis, the radii of the rings decreasing from an uppermost ring to a lowermost ring;

b) a plurality of rods of substantially trapezoidal cross section arranged outside the rings, the wider parallel surface of each rod being attached to each one of the plurality of rings at equal intervals along the length of one side of said rod to define screen apertures, the rods being spaced equidistant apart to define a continuous constant width slot between said rods.

25. A screen according to claim 24, wherein the screen is substantially frusto-conical.

26. A screen according to claim 24, wherein said rods are arranged substantially perpendicular to said rings.

27. An apparatus according to claim 1, wherein said elutriation inlet is spaced a radial distance from the axis of rotation which is less than the spacing of the screen from the axis of rotation creating a pressure difference between the elutriation liquid entering the outer portion of the chamber and the slurry retained against the screen when the chamber is rotated such that elutriation liquid continuously flows from the outer portion to the inner portion of the chamber through the screen whereby slurry retained against the screen is continuously agitated.

28. An apparatus according to claim 1, wherein said elutriation inlet communicates with at least one conduit and a corresponding number of ports in the outer portion of the chamber, each conduit having open upper and lower ends, the upper end of each conduit being in permanent registry with one of the corresponding ports, the conduits being rotated with the chamber when the apparatus is operated, the lower ends of the conduits having vanes for accelerating the flow of the elutriation liquid, the upper ends of the conduits being spaced a radial distance from the axis of rotation greater than the spacing of the lower ends from the axis of rotation, and the lower end of each conduit being spaced from the axis of rotation by a radial distance which is less than the spacing of the screen to the axis of rotation creating a pressure in the elutriation liquid which is higher than the pressure of the slurry retained against the screen when the chamber is rotated whereby the slurry retained on the screen during rotation is continuously fluidized.

* * * * *